United States Patent [19]

Fontana et al.

[11] Patent Number: 4,951,822

[45] Date of Patent: Aug. 28, 1990

[54] RIB OF BOTTLES FOR PHARMACEUTICAL, COSMETIC AND OTHER PRODUCTS

[75] Inventors: Antonio Fontana; Giovanni Ferrari, both of Carpi; Euro Fabbri, Rovereto di Novi, all of Italy

[73] Assignee: Lameplast S.R.L., Modena, Italy

[21] Appl. No.: 303,883

[22] Filed: Jan. 30, 1989

[30] Foreign Application Priority Data

Jan. 28, 1988 [IT] Italy ..... 40015 A/88
May 4, 1988 [IT] Italy ..... 40066 A/88
Jan. 11, 1989 [IT] Italy ..... 40007 A/89

[51] Int. Cl.[5] ..... B65D 1/08; B65D 17/24; B65D 85/62

[52] U.S. Cl. ..... 206/530; 206/820

[58] Field of Search ..... 206/820, 530, 343, 339, 206/532, 528; 215/32

[56] References Cited

U.S. PATENT DOCUMENTS 4,174,040 11/1979 Wang ..... 206/820
4,512,475 4/1985 Federichi ..... 206/820

*Primary Examiner*—Paul T. Sewell

*Assistant Examiner*—Jacob K. Ackun, Jr.

*Attorney, Agent, or Firm*—Lowe, Price, LeBlanc, Becker & Shur

[57] ABSTRACT

A strip like structure is formed in the shape of a succession of phials, of a heat-sealable plastic, with the phials molded with their respective bases open and their mouths each closed by a removable stopper element, each of the phials having a first set of webs disposed transversely about the middle of their respective longitudinal axis and a second set of webs formed at the mouth ends with narrow stiffening ribs on either side of an uppermost edge thereof, the first and second webs serving to interconnect the phials and the removable stopper elements closing the same, respectively. The interconnecting webs are provided with relative weakening creases located preferably midway between each two adjacent phials and disposed parallel to the phial longitudinal axis. Each terminal web of the second set has transverse butt portion disposed at right angles to the plane of the web, the butt having a width not greater than the width of the phial and a height equal to a depth of the second web.

10 Claims, 6 Drawing Sheets

RIB OF BOTTLES FOR PHARMACEUTICAL, COSMETIC AND OTHER PRODUCTS

FIELD OF THE INVENTION

This invention relates to a strip of phials intended for pharmaceuticals, cosmetics and other products, that is, a string of single containers fashioned in suitable heat-sealable plastic material, connected and readily detachable one to and from the next, with open bottom ends that can be positioned to receive a given preparation (a liquid, cream, paste or powder, typically though by no means exclusively of pharmaceutical or cosmetic composition), and then heat-sealed.

BACKGROUND OF THE PRIOR ART

The prior art embraces such phials in strip format, which are connected one to the next generally via sets of webs arranged in pairs and projecting from either side of each phial; a top set interconnects the caps or stoppers, whilst the phials themselves are interconnected by a set running down the middle of the strip.

The top webs are slender, and present ribs on either side of the uppermost edge, close to where injection occurs during the moulding process; each web also exhibits a pronounced reduction in cross section, halfway between and parallel to the axes of the two interconnected phials, providing a crease along which to separate one phial from the next in readiness for use. The web can either be snapped cleanly, or bent back and forth until weak enough to be pulled apart.

This conventional type of strip causes definite handling drawbacks in manufacture, namely, when dispensed empty from an initial supply bin, and during the subsequent filling, heat-sealing and packaging operations: on the one hand, the strips can become entangled and pile up, excluding any possibility whatever of automation and dictating the use of manual methods, the consequences of which are increased costs and substandard results; on the other hand, even where handling is smooth, the speed obtainable remains low with a strip of the type in question, which is rendered unstable by its tendency to bend when conveyed longitudinally in the usual upturned vertical position.

Accordingly, the prior art stands in need of marked improvement, in order to overcome such drawbacks.

It will be discerned from the foregoing that the requirement is for a heat-sealable plastic strip embodied in such a way that it will neither become entangled with and pile up on top of other strips, nor bend when conveyed and handled, even forcibly, during its passage through the various stations of a production line; this much achieved, the relative manufacturing operations can be fully automated, the strips moved around at high speed, and a fast, well-ordered and uninterrupted flow can be ensured between supply bin and final packaging.

SUMMARY OF THE INVENTION

According to preferred embodiment of the invention, the stated requirement is met by adopting a first expedient designed to prevent the strips from becoming entangled and piling up on one another when conveyed along a production line. In the strip disclosed, the top webs are deep, and stiffened by a rib extending wide from either side of the uppermost edge in such a way as to ensure a firm stance to the strip when conveyed in the upturned position; also, each end of the strips affords a generous transverse butt moulded into the terminal top web, which liks in a plane at right angles to that occupied by the webs.

More exactly, the width of these transverse butts is less than or equal to the width of the phial whilst their height matches the depth of the top webs.

A similar butt is also provided at each end of the middle of the strip, moulded to a lug matching the relative set of webs; in this instance, the butt is reduced in height, and associates not only with the projecting edge, but also with the side faces of the lug, by way of a pair of triangular ribs that bridge the dihedral angles between the butt and the two faces. The two butts occupy the same plane and are identical in width.

According to a second aspect of the invention, adopted to prevent the strip from bending when conveyed at speed, the weakening creases in the middle and top webs that interconnect each two adjacent phials are moulded with irregular profiles, or at all events, with at least one stretch either skew or perpendicular in relation to the axes of the phials, rather than parallel. Preferred examples would be a chevron, a single straight crease converging with or diverging from parallel, an arc, or a zig-zag.

The advantages afforded by the invention are: elimination of the danger that single strips of phials may entangle and pile up; avoidance of the strip bending under axial stress; the possibility of exploiting automated, high speed transfer from an initial supply bin, holding the empty strips, through filling and heat-sealing to final wrapping; also, increased productivity and reduced costs.

BRIEF DESCRIPTION OF THE DRAWINGS

The invention will now be described in detail by way of example with the aid of the accompanying drawings, in which.

DESCRIPTION OF THE PREFERRED EMBODIMENTS

Figure 3:
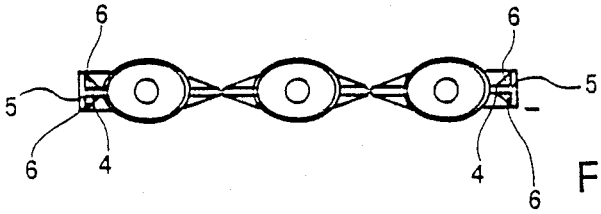
FIG. 3 is a plan view of FIG. 1 from beneath.

In the drawings, 1 denotes the shell of the single phial, the base 1' of which is enlarged all round to ensure a faultless heat-seal; adjacent phials are joined by intermediate webs 2 issuing from the shells 1 substantially at mid-height and exhibiting moulded creases 3 by means of which one phial can be separated from the next in conventional manner.

4 denotes a terminal lug, positioned at mid-height on the strip in alignment with the webs 2, which affords a transverse butt 5 positioned at right angles to the axis of the lugs and parallel with that of the phial 1, for engagement by conveying means, and a pair of triangular ribs 6, occupying the median longitudinal plane of the strip normal to that occupied by the webs 2 and lugs 4 and set at dihedral angles in relation to the lug 4 itself.

7 denotes a generously-proportional web associated with the top of each terminal phial of the strip, and in a preferred embodiment, significantly larger than the corresponding middle web 2 and lug 4; the intermediate phials similarly exhibit a top web 6' of dimensions identical to those of the terminal webs 7. The top webs 7 and 7' also connect by way of creases 8 in conventional manner.

9 denotes a tapered stiffening rib integral with and projecting either side of the uppermost edge of each top web 7 and 7'; 10 denotes a transverse butt associated with each terminal web 7 and occupying the same plane as the middle butt 5, hence parallel with the phial axis in similar fashion. The butt 10 is merged with and matched to the full width of the rib 9, and identical in height to the depth of the top webs 7 and 7'. Moreover, the width of the transverse butts 5 and 10 will be less than, or at most, equal to the overall transverse dimension of the phial.

Figure 1:
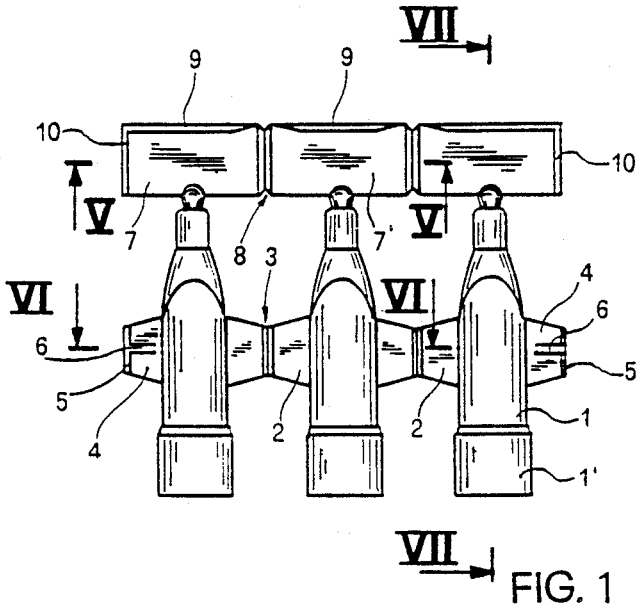
FIG. 1 is the side elevation of a strip of phials according to the invention, seen prior to being filled and sealed, which incorporates entanglement and pile-up prevention means.
Figure 2:
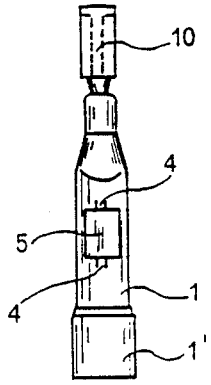
FIG. 2 is a plan view of FIG. 1 from the left.
Figure 4:
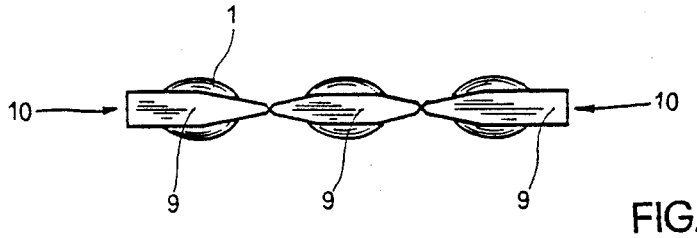
FIG. 4 is a plan view of FIG. 1 from above.
Figure 5:
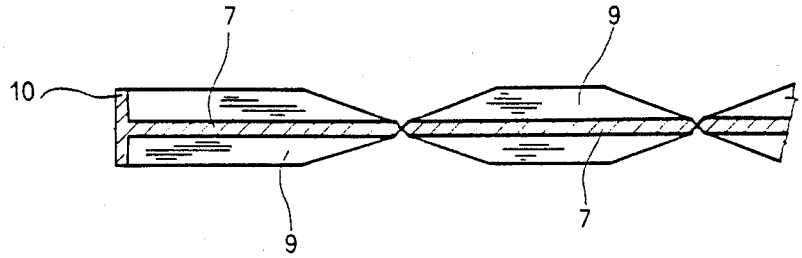
FIG. 5 is the section through V—V in FIG. 1, viewed on larger scale.
Figure 6:
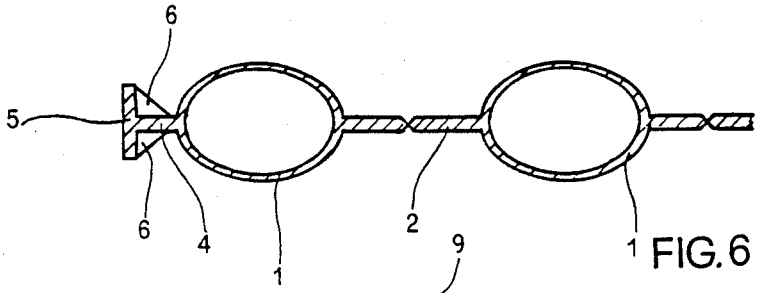
FIG. 6 is the section through VI—VI in FIG. 1, viewed on a larger scale.
Figure 7:
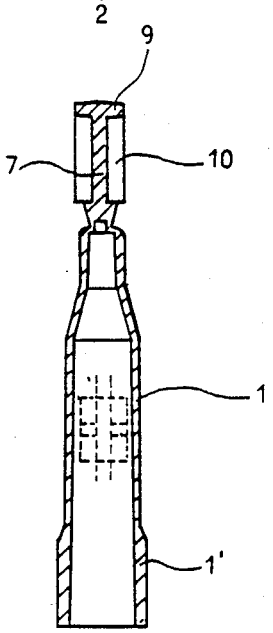
FIG. 7 is the section through VII—VII in FIG. 1, viewed on a larger scale.
Figure 8:
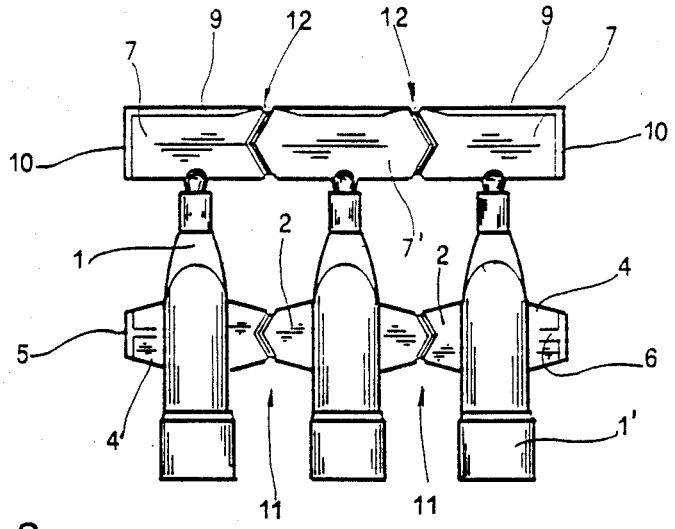
FIG. 8 is a side elevation of a strip of phials incorporating bend-prevention means that consist in outwardly directed chevron creases.

With reference now to FIG. 8, it will be seen that the conventional straight crease 3 in each middle web 2, which in FIG. 1 lies parallel with the axis of the phial, is replaced by a crease 11 consisting in two straight stretches that converge to create a chevron with the point directed toward one end of the strip. 12 denotes a crease of similar chevron shape connecting the adjacent top webs 7 and 7', and replacing the equivalent straight crease 8 of FIG. 1 which lies parallel with the phial axis.

Figure 9:
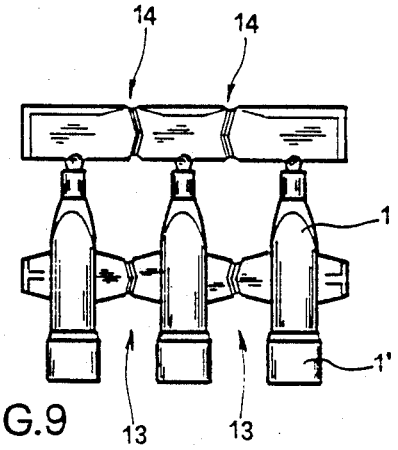
FIG. 9 is an elevation similar to that of FIG. 8, in which the chevron creases are directed inward.
Figure 10:
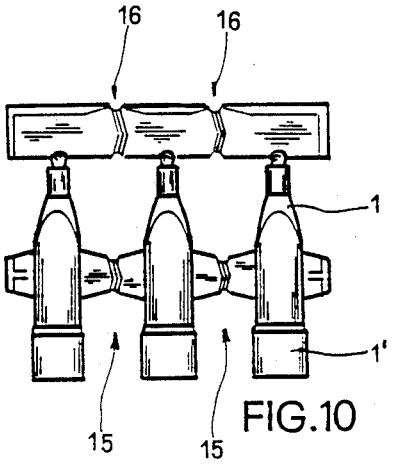
FIGS. 10 and 11 are elevations as in FIG. 8, showing top and middle sets of chevron creases that face in the same direction and in opposite directions, respectively.
Figure 11:
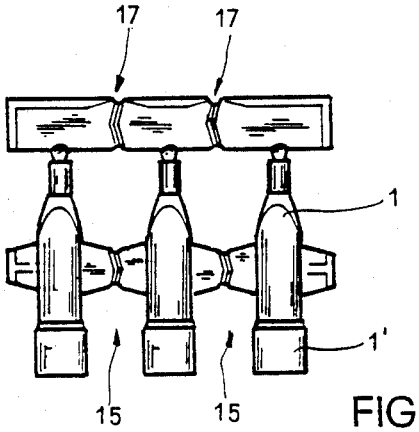

FIG. 9 shows chevron creases 13 and 14 identical in embodiment to the creases 11 and 12 of FIG. 8, but directed inwards; FIG. 10 shows chevron crease 15 and 16 that point in the same direction throughout, whilst in FIG. 11, the middle set and the top set of creases 15 and 17 point in opposite directions.

Figure 12:
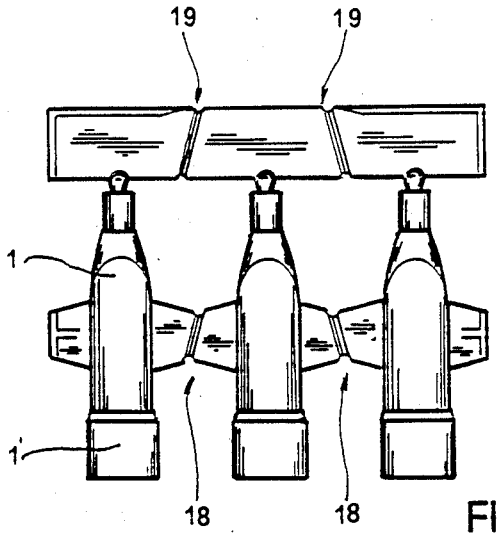
FIG. 12 is an elevation similar to that of FIG. 8, in which bend-prevention means consist in straight creases that are disposed at a given angle and converge upwards.
Figure 13:
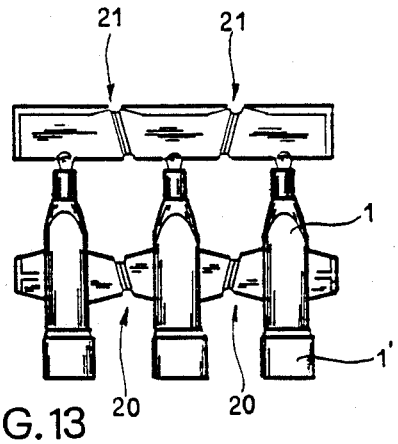
FIG. 13 is an elevation similar to that of FIG. 8, in which the angled creases converge downwards.
Figure 14:
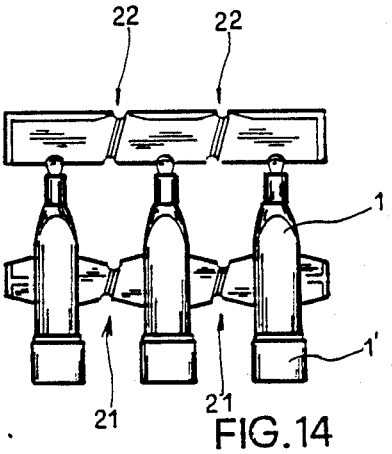
FIGS. 14 & 15 are elevation views as in FIG. 8, showing top and middle sets of creases that are angled in the same direction and in opposition directions, respectively.
Figure 15:
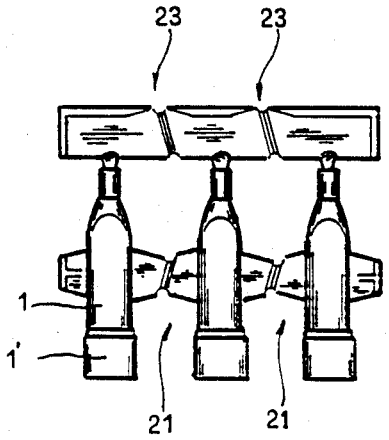

In FIG. 12, the creases 18 and 19 consist in single straight stretches that are angled, and converge upwards in pairs; FIG. 13 shows creases 20 and 21 that are identical in embodiment to the creases 18 and 19 of FIG. 12, but converge downwards; FIG. 14 shows angled creases 21 and 22 disposed parallel with one another throughout, whereas in FIG. 15, the middle and top sets of creases 21 and 23 are angled in opposite directions.

Figure 16:
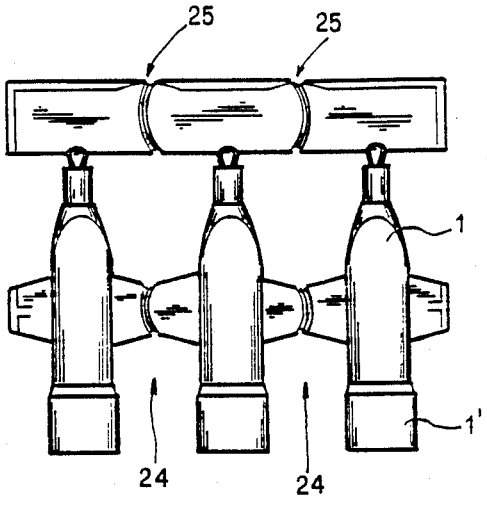
FIG. 16 is an elevation view similar to that of FIG. 8, in which bend-prevention means consist in curved creases positioned with the concave sides directed inwards.

In FIG. 16, the creases 24 and 25 exhibit a curved profile, with concave sides directed inwards, which may be considered as resultant of a series of vertical and horizontal components.

The relative arc subtends an angle not greater than 180°.

Figure 17:
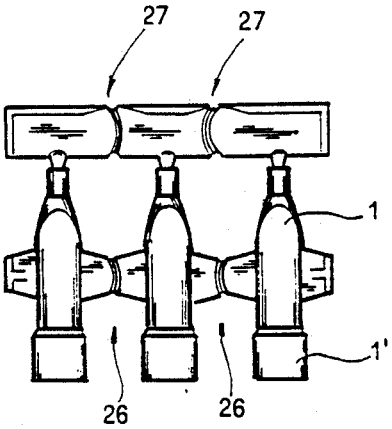
FIG. 17 is an elevation view similar to that of FIG. 8, in which the curved creases are positioned with concave sides directed outwards.
Figure 18:
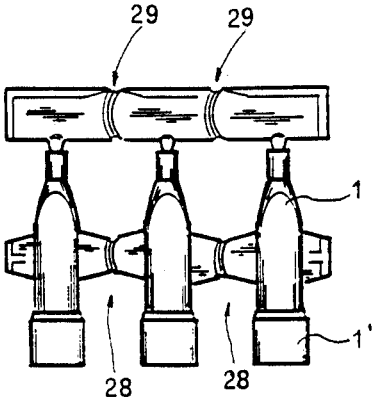
FIG. 18 is an elevation view similar to that of FIG. 8, in which the concave sides of the curved creases face in one direction throughout.

FIG. 17 shows curved creases 26 and 27 identical to the creases 24 and 25, with concave sides directed outwards, whereas in FIG. 18 the same curved creases 28 and 29 are disposed with their concave sides facing in the same direction throughout.

Figure 19:
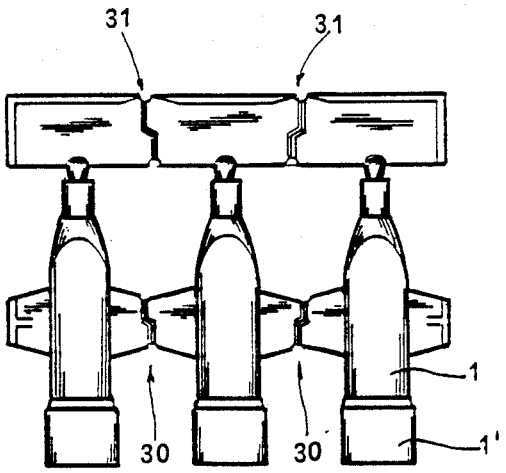
FIG. 19 is an elevation view similar to that of FIG. 8, in which the bend-prevention means are staggered creases composed of two vertical and parallel stretches interconnected by a third sub-horizontal stretch.
Figure 20:
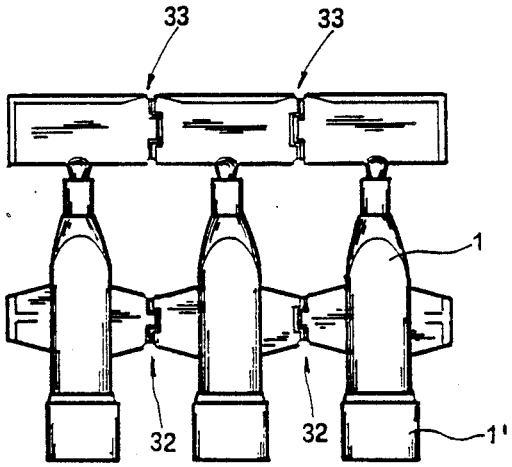
FIG. 20 is an elevation view similar to that of FIG. 8, in which the staggered creases are composed of three vertical stretches, the two endmost aligned and the central strecht offset and parallel, interconnected by substantially horizontal fourth and fifth stretches.
Figure 21:
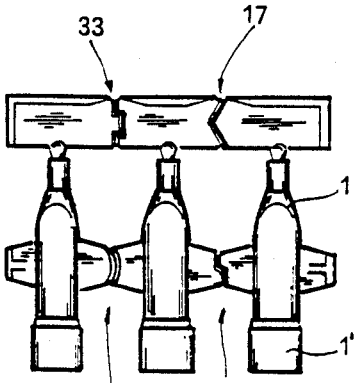
FIG. 21 is an elevation view similar to that of FIG. 8, showing a less preferable arrangement of mixed creases, all of which exhibit at least one stretch disposed skew in relation to the axis of the phial.

FIG. 19 illustrates creases 30 and 31 of staggered outline, consisting in three distinct stretches of which two are vertically disposed and parallel, and the third interconnecting stretch sub-horizontal;

FIG. 20 also shows creases 32 and 33 of staggered outline, in this instance composed of five distinct stretches—viz, two vertically aligned stretches and an intermediate third stretch offset from and parallel with the first two, interconnected by essentially horizontal fourth and fifth stretches.

Figure 22:
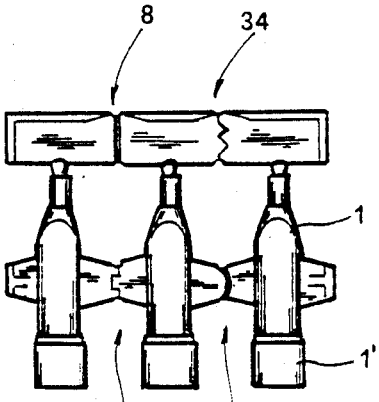
FIG. 22 is an elevation view similar to that of FIG. 8, showing an arrangement of mixed creases, including one crease of zigzag profile, and another crease entirely parallel with the axis of the phial, as in embodiments typical of the prior art of the three applications for Italian patent filed by the same applicant, the subject matter of which is disclosed herein.

Finally, FIG. 22 illustrates an additional crease 34 of zigzag profile.

In practical application, single strips of plastic phials 1 turned out by the mould are deposited in a supply bin, from which they will then be dispensed singly by a suitable device to a batching line and conveyed forward toward the filling and heat-seal stations, proceeding in the conventional upturned vertical position, guided by fences on either side, with the stiffening flanges 9 of the upturned top webs 7 and 7' lying flat on the conveyor.

The strips are prevented from catching and locking together at the ends by the triangular ribs 6, no matter how irregular the flow may happen to be.

In effect, the strips are conveyed nose to tail, each propelled by the one behind, and their correct longitudinal alignment is ensured by the matched butt ends 5 and 10 both during the movements that take the strips through the filling and heat-seal operations and during those that take them toward the packaging station; accordingly, any risk of a pile-up is successfully avoided.

As to the question of ensuring that the molded plastic strip does not bend or kink, it will be noted that the creases of chevron shape 11, 12, 13, 14, 15, 16, 17, the straight angled creases 18, 19, 20, 21, 22, 23, the curved creases 24, 25, 26, 27, 28, 29, and the types of crease with three staggered stretches 30, 31, five stretches 32, 33, or zigzag profile 34, all incorporate at least one stretch disposed skew in relation to the axis of the phial, the effect of which is to stiffen the strip and reduce its tendency to bend.

Finally, with the base 1' of the shell 1 of each phial suitably enlarged according to the invention, one avoids the splitting and cracking that often occurs with conventional mouldings, thus ensuring an efficient seal and reducing waste.

The foregoing specification implies no limitation of the scope of the invention. For example, the number of phials making up a single strip might be greater or lesser than three as illustrated, as indeed their geometry might also vary according to ultimate use.

As for the shape of the weakening creases, this too might be modified, within the recited scope of the invention, in order to obtain varying degrees of stability commensurate with effective requirements.

Lastly, notwithstanding the advantage of adopting the same type of crease for both the top and the middle set of webs, and in particular the chevron, which is notably economical and easily implemented, there is nothing to prevent the illustrated shapes being developed even further, and even (albeit less profitably) utilized in combination with the conventional crease disposed parallel to the phial axis.

Still other objects and advantages of the present invention will become readily apparent to those skilled in this art from the preceding detailed description, wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive, the invention being defined solely by the claims appended hereto.

We claim:

1. A strip-like structure including a plurality of phials for pharmaceuticals, cosmetics and other products, comprising:

a succession of phials formed of a heat-sealable plastic, molded with their respective bases open and mouths each closed by a removable stopper element, each phial having a first set of webs disposed transversely and about the middle of the longitudinal axes of the respective phials, and a second set of webs formed at the mouth ends with narrow stiffening ribs on either side of an uppermost edge thereof, said first and second webs serving to interconnect the phials and the removable stopper elements closing the same, respectively, said interconnecting webs being provided with relatively weakened creases located mid-way between each two adjacent phials and disposed parallel to the phial longitudinal axes, wherein each terminal web of the second set has a transverse butt portion disposed on the ends of and at right angles to the plane of the web and of a width not greater than the width of the phial and of a height equal to a depth of the second web, wherein said second set of webs comprises terminal webs at each end and intermediate webs therebetween, said terminal webs each being formed with a transversely-oriented butt portion formed integrally with the respective stiffening ribs of said terminal webs, wherein the first set of webs also comprise terminal webs at each end and intermediate webs therebetween; the terminal webs of the first set being formed as lugs, each having a transverse butt portion disposed on the ends of and at right angles to the plane of the lugs and being provided with a pair of triangular entanglement-prevention ribs that bridge the dihedral angles between the planes occupied by the lug and the transverse butt portion, and wherein each pair of intermediate webs interconnecting two adjacent phials connect at a weakened crease located mid-way between the axes of the two adjacent phials.

2. A strip of phials as in claim 1, wherein:

a predetermined number of the weakening creases are provided by the middle and top webs and are fashioned with at least one stretch disposed inclined with respect of the axis of the phial to prevent the strip from bending.

3. A strip of phials as in claim 2, wherein:

a predetermined number of the weakening creases of the middle and top webs present one of a broken profile, a curved profile, a mixed linear profile, and a straight line mid-way between and parallel with the axes of adjacent phials.

4. A strip of phials as in claim 2, wherein:

at least one web exhibits a weakening crease appearing as a straight line that is angled convergently in one given direction toward the axis of an adjacent phial.

5. A strip of phials as in claim 1, wherein:

at least one web exhibits a weakening crease appearing as a chevron with the point thereof directed toward one end of the strip.

6. A strip of phials as in claim 1, wherein:

at least one web exhibits a curved weakening crease that appears as an arc, subtending an angle not greater than 180° and disposed with its concave side directed toward one end of the strip.

7. A strip of phials as in claim 1, wherein:

at least one web exhibits a staggered weakening crease comprising two vertical stretches, upper and lower, mutually offset in either direction and parallel with the axis of an adjacent phial, and an intermediate third stretch disposed substantially normal thereto, by which the ends of the two vertical stretches are interconnected.

8. A strip of phials as in claim 1, wherein:

at least one web exhibits a staggered weakening crease comprising two vertically aligned stretches, upper and lower, an intermediate third vertical stretch lying parallel with respect to the two aligned stretches, and fourth and fifth substantially horizontal intermediate stretches by which the ends of the three vertical stretches are interconnected.

9. A strip of phials as in claim 1, wherein:

at least one web exhibits a weakening crease having a zigzag profile, comprising at least two central stretches converging on a transverse axis to form a chevron, and two further stretches connecting said chevron with two respective end stretches lying mid-way between and parallel with the longitudinal axes of the adjacent phials.

10. A strip of phials as in claim 2, wherein:

said weakening creases are fashioned with at least one stretch perpendicular to the axis of the shell.

* * * * *